US005511330A

United States Patent [19]

Havens

[11] Patent Number: 5,511,330

[45] Date of Patent: Apr. 30, 1996

[54] LOUVER SIGN TRANSMISSION SYSTEM

[76] Inventor: Dale I. Havens, 11101 Devils Lake Hwy., Addison, Mich. 49220

[21] Appl. No.: 402,465

[22] Filed: Mar. 10, 1995

[51] Int. Cl.[6] ..... G09F 11/02

[52] U.S. Cl. ..... 40/505; 74/606 R; 74/665 GB

[58] Field of Search ..... 40/503, 504, 505; 74/606 R, 665 GB

[56] References Cited

U.S. PATENT DOCUMENTS

| | | | |
|---|---|---|---|
| 1,461,047 | 7/1923 | Ray | 40/505 |
| 5,161,421 | 11/1992 | Stigsson | 40/505 X |
| 5,259,135 | 11/1993 | Bannister et al. | 40/505 X |

*Primary Examiner*—Brian K. Green
*Attorney, Agent, or Firm*—Beaman & Beaman

[57] ABSTRACT

A transmission system for louver type signs wherein the signs consist of a plurality of multiple faced louvers having indicia defined thereon and the side-by-side relationship of the louvers permits pre-selected faces to define a completed image and simultaneous partial rotation of the louvers presents a new visible image, and wherein, each louver is operated by a separate "T" drive bevel gear transmission having an output shaft upon which a louver is mounted operatively connected to a drive shaft perpendicularly related to the output shaft. The drive shafts of adjacent transmissions are interconnected and a plurality of transmissions are simultaneously operated by a single motor drive source. The cost of the transmissions is significantly reduced by the use of a unique bearing support system for the drive and output shafts eliminating the need for separate bearings in that the material of the transmission casing constitutes the shafts' bearing surfaces.

7 Claims, 3 Drawing Sheets

LOUVER SIGN TRANSMISSION SYSTEM

BACKGROUND OF THE INVENTION

1. Field of the Invention

The invention pertains to "T" drive bevel gear transmissions for louver type signs wherein a plurality of multifaced elongated louvers have indicia or images appearing on the faces thereof wherein pre-determined faces aligned in co-planar relationship produce a complete image, and partial simultaneous rotation of the louvers changes the appearance of the sign by making another louver indicia bearing face visible.

2. Description of the Related Art

Louver type signs require that a plurality of relatively long and narrow elements or louvers be mounted in side-by-side relationship wherein, as the louvers are indexed to present different faces for observation the longitudinal edges of adjacent louvers will be closely spaced as to permit a continuity of images appearing on a plurality of adjacent louver faces. The louvers are usually provided with three sides or faces, and the louvers are usually indexed at a pre-determined time cycle, such as to "show" a different louver face about every minute. Accordingly, with a three sided louver, the rate of indexing, or rotation, of a louver may be one-third of a revolution per minute.

In the past, it has been the common practice to simultaneously rotate or index the louvers constituting a complete sign by means of a belt or chain arrangement. Each of the louvers includes a drive mechanism operatively connected to a belt or chain system whereby a motor driving the belt or chain system will periodically operate to index the louvers to present a new visible louver face. With a three sided louver, only a 120° rotation of the louver is required during each indexing cycle.

In order to provide optimum sign appearance wherein the images of adjacent louvers visibly blend and align with each other, it is necessary that the louvers accurately operate together and index accurately. Louver drive systems using belts and chains encounter a number of problems which adversely affects the operation and accuracy of indexing of the louvers. Malfunctioning will occur due to stretching or slipping of the belts or chains, breakage of the belts or chains, and problems occur maintaining the belts or chains in proper alignment in tracking and driving relationship to the associated sprocket or pulley.

With present transmissions for louver type signs, the dependability and long term maintenance-free operation desired has not been available, and louver type signs are expensive to operate and service.

OBJECTS OF THE INVENTION

It is an object of the invention to provide a louver type sign transmission system wherein adjacent louver transmissions are of the gear driven type, and belt or chain drives between adjacent louver transmissions is eliminated.

An additional object of the invention is to provide a transmission system for louver type signs wherein each louver is provided with a gear type transmission, and adjacent transmissions are positively interconnected in driving and driven relationships in order to produce simultaneous operation of a plurality of interconnected transmissions, and produce simultaneous louver indexing.

Yet another object of the invention is to provide a transmission system for louver type signs wherein each louver is associated with a gear type transmission having drive and output shafts, and the transmissions are of an inexpensive, yet dependable, construction.

A further object of the invention is to provide a gear type transmission for louver type signs wherein the transmission includes drive and output shafts rotatably supported within a casing having interconnectable parts, the casing material, itself, constituting the bearing for the transmission shafts, and the casing parts being of such construction as to accurately position the shafts and maintain shaft position during transmission operation.

SUMMARY OF THE INVENTION

Louver type signs usually consist of a plurality of elongated louvers or elements arranged in side-by-side vertical relationship. Each of the louvers includes a plurality of indicia bearing faces, and as the usual louver construction uses three faces, the louvers are usually of a triangular transverse cross section. The louvers constituting a sign are simultaneously indexed whereby the planar surface of a louver face is co-planar with an adjacent louver face and the longitudinal lateral edges of the visible faces of adjacent louvers are disposed close to each other wherein indicia appearing on one louver is continued by indicia defined on an adjacent louver, and the adjacent relationship of the edges of the louver faces produce the appearance of a continuous image. By indexing the louvers about their longitudinal axes to make another indicia bearing face visible, the entire image of the complete sign may be rapidly changed, and louver type signs, although expensive to install and operate, are used in indoor and outdoor advertising at high traffic density locations wherein three separate advertisers may appear on a single sign, or a single advertiser may sponsor three different sign images of graphics and text.

In the practice of the invention, the lower end of each louver is mounted upon a support pad located at the end of a gear type transmission output shaft. The output shaft is rotatably located within a gear transmission casing consisting of two parts interconnected by threaded screws or bolts.

Each louver transmission includes a drive shaft rotatably supported within its transmission casing and each drive shaft includes an input portion and an output portion. A bevel gear mounted upon the drive shaft within the transmission casing meshes with a bevel gear mounted upon the output shaft wherein rotation of the drive shaft produces an equal rotation of the output shaft and associated louver. A thrust bearing mounted upon the output shaft supports the weight of the louver.

The axes of the drive shafts of the transmissions are coaxially related, and the input portion of each drive shaft is connected to the output portion of an adjacent transmission drive shaft by a torque transmitting connector, while the output portion of each drive shaft is connected to the input portion of the adjacent transmission. In this manner, the drive shafts, and output shafts, of each transmission are simultaneously operated.

Rotation of the interconnected drive shafts may be produced by an electric motor operatively connected to one of the drive shafts by a chain sprocket, gearing, or other conventional drive system. Accordingly, when the transmission drive shaft connected to the motor is indexed by its motor for 120°, all of the interconnected drive shafts will index a similar extent producing a similar indexing of the output shafts and associated louvers.

Because the rate of rotation of the drive shafts and output shafts is slow, for instance, one-third of a revolution per minute, expensive bearing structure for the transmission drive shafts and output shafts is not required. The transmission casing parts may be cast of an aluminum material, and the steel drive and output shafts directly engage the material of the casing parts.

In the practice of the invention, separate bearings for the drive shafts and output shafts are not utilized, and this construction significantly reduces the cost of the transmissions with respect to similar devices utilizing sleeve or anti-friction bearings, and in the practice of the invention, one of the casing parts has a semi-cylindrical recess defined in the casing parting surface which is of a diameter substantially equal to the associated drive or output shaft and this recess accurately locates the associated drive or output shaft with respect to the transmission casing and associated structure.

A generally semi-cylindrical recess is also defined in the other transmission casing part in opposed relationship to the previously mentioned casing part, however, the second recess is of a diameter larger than the diameter of the associated drive or output shaft, and the circumferential extent of the second recess is less than 180°. Accordingly, a central apex is defined in the second recess midway between the intersection with the associated casing part parting surfaces. When assembling the transmission casing parts, the apex of the second recess will engage the associated drive or input shaft in line contact holding the opposed portion of the drive or input shaft within the semi-cylindrical recess of the other casing wherein, in effect, the drive or input shaft is engaged throughout approximately one-half of its circumference, but is firmly maintained within the recess of the first casing part by the force exerted on the associated shaft by the apex engagement of the second recess with the shaft circumference. By supporting the transmission drive shaft and output shaft in the above manner, the shafts will be accurately located within the transmission casing by the first casing part recess, and the material of the casing parts directly serves as the bearing material for the shafts.

The transmission casing parts are economically formed of aluminum or similar material by injection molding, and as the drive shafts and input shafts, and associated bevel gearing, may be economically manufactured, and the casing readily assembled, transmission casings constructed in accord with the invention economically compare with previous louver type sign drive systems, and the elimination of separate bearings for the drive and output shafts eliminates costly assembly and bearing costs. Louver type signs constructed in accord with the inventive concepts are more dependable in operation than previous type louver type sign transmission systems, and the objects of the invention are achieved by the apparatus disclosed and claimed.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
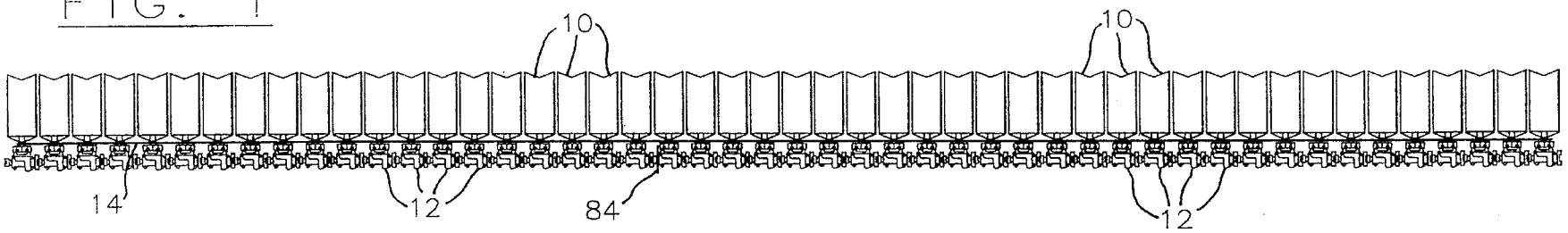
FIG. 1 is a partial elevational detail view of a louver type sign illustrating a plurality of interconnected transmissions.

A general partial elevational detail view of a louver type sign utilizing the concepts of the invention is shown in FIG. 1. In FIG. 1, the lower portion of the louvers 10 are illustrated, and the lower end of the louvers 10 are each connected to a transmission generally indicated at 12. The transmissions 12 are mounted upon the underside of an elongated support plate frame 14 which constitutes the primary support for the transmissions and the louvers. Normally, the louvers 10 will be vertically oriented and the support frame plate 14 horizontally disposed. However, it is possible to construct a louver type sign wherein the louvers are horizontally disposed.

Figure 2:
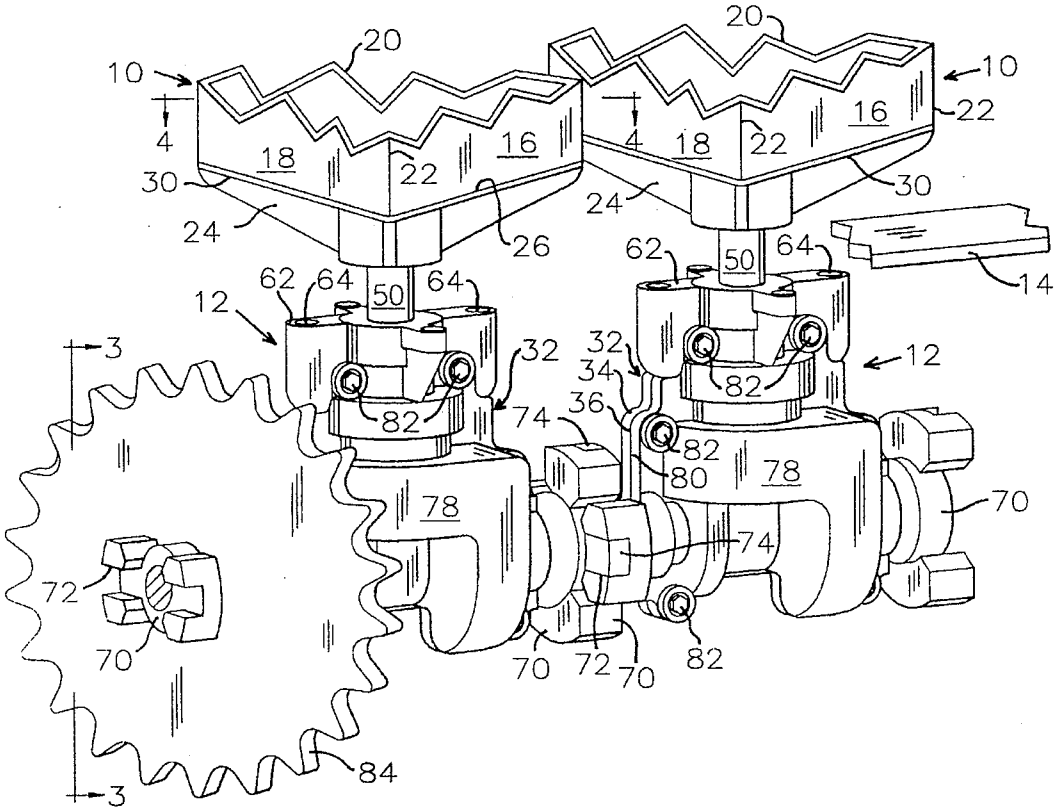
FIG. 2 is an enlarged perspective view illustrating a pair of interconnected transmissions.
Figure 4:
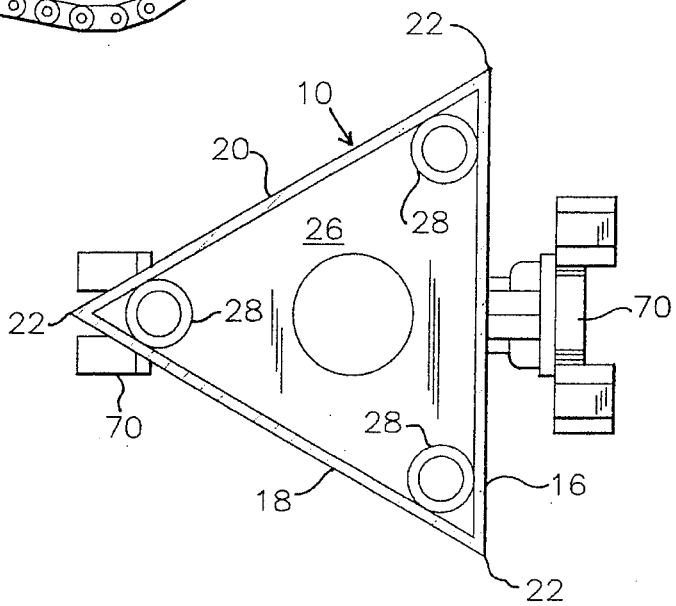
FIG. 4 is a top plan sectional view of a louver and louver supporting pad as taken along Section 4—4 of FIG. 2.

Typically, a louver 10 is of a triangular cross sectional configuration as will be apparent from FIGS. 2 and 4, and the louver includes three exterior faces 16, 18 and 20 of equal dimension interconnected at their edges 22. The faces 16–20 are planar, and as well known, indicia, such as text or graphic art, is applied to the faces 16, 18, or 20 whereby the indicia formed on adjacent visible faces blends with the indicia on the adjacent louver faces wherein the composite indicia on faces 16, for instance, will simultaneously be visible on all of the louvers wherein the composite indicia defines a single billboard, sign or image. Different indicia than that appearing on faces 16 will be applied to the faces 18 wherein coplanar alignment of the faces 18 will result in a different sign upon a 120° rotation of the louvers 10, and likewise, a further 120° rotation of the louvers will make the faces 20 visible permitting a third image to be visible upon partial rotation of the louvers about their longitudinal axes.

Each of the louvers 10 is mounted upon a triangular louver pad 24 having a planar support surface 26 formed thereon. A plurality of bosses 28, FIG. 4, extend from the support surface 26 and are of such dimension and location as to be firmly received within the interior corners of the louver as appreciated from FIG. 4. The louver lower edge 30 rests upon the louver pad support surface 26, and in this manner each louver 10 is supported by its associated pad 24 and rotatable about its longitudinal axis upon rotation of the associated pad 24.

Each louver pad 24 is mounted upon a separate transmission 12, and each transmission 12 includes a casing 32, FIG. 2. Each transmission casing 32 is identical, and includes a main or primary casing part 34 which constitutes a half of the casing. The casing part 34 is preferably injection molded of an easily moldable metal such as of an aluminum composition, and the part 34 includes a flat parting surface 36, FIG. 5, which is in opposed relationship to the parting surface of the secondary casing part as later described.

Figure 5:
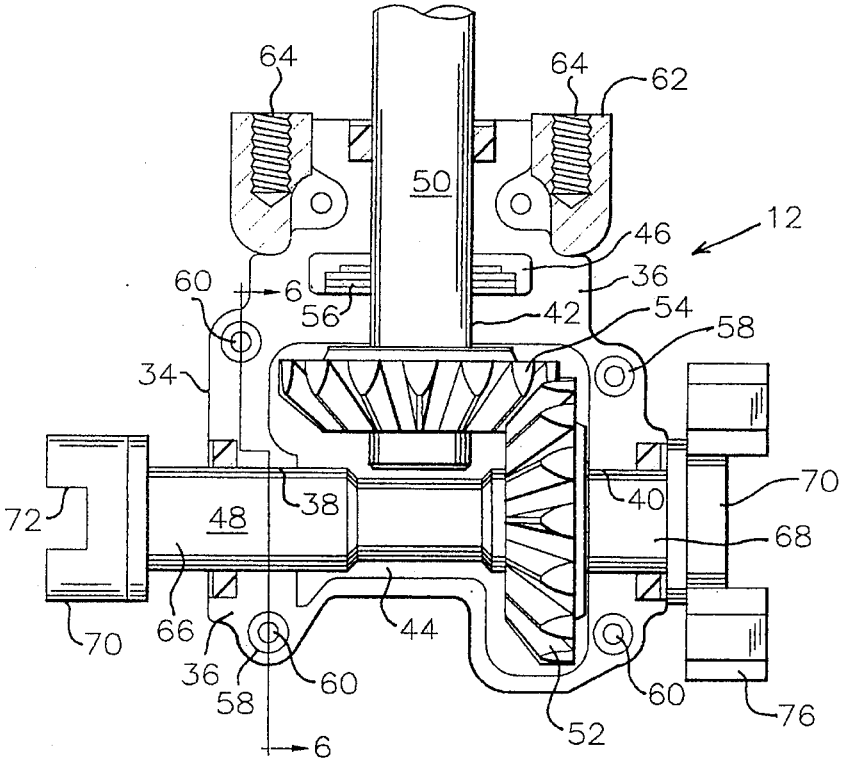
FIG. 5 is an elevational view of the primary transmission casing half with the secondary casing half being removed.

The casing part 34 includes a pair of semi-cylindrical drive shaft receiving recesses 38 and 40, FIG. 5, which have coaxial axes. Also, the casing part includes a semi-cylindrical recess 42 having an axis perpendicular to the axes of recesses 38 and 40 for receiving the transmission output shaft. The recesses 38, 40 and 42 are of a true semi-cylindrical configuration wherein the plane of the casing parting surface 36 constitutes a diameter of these semi-cylindrical recesses.

The recesses 38 and 40 intersect an enlarged chamber 44 defined in the casing part 34, and a smaller thrust bearing chamber 46 is also defined in the casing part as intersected by the recess 42.

The transmission drive shaft 48 is received within the recesses 38 and 40 as will be appreciated from FIG. 5, and the transmission output shaft 50 is received within the semi-cylindrical recess 42. The output shafts 50 extend through the frame plate 14. The louver pad 24 is mounted upon the upper end of the drive shaft 50 as will be appreciated from FIG. 2.

A bevel gear 52 is mounted upon the drive shaft 48 for rotation therewith as located within the chamber 44, FIG. 5, and a similar bevel gear 54 located upon the inner end of the output shaft 50 is located within chamber 44 in meshing relationship with gear 52. The gears 52 and 54 are identical in diameter and tooth size wherein one rotation of drive shaft 48 will result in a single rotation of output shaft 50. A thrust bearing 56 is mounted upon the output shaft 50 within the chamber 46, and the thrust bearing 56 supports axial forces imposed upon the output shaft 50 due to the weight of the louvers 10.

A plurality of annular bosses 58 extend from the parting surface 36, and internally, each of the bosses 58 is provided with a threaded hole 60 for receiving the screw fasteners which interconnect the casing parts, as later described.

At its upper end, FIG. 5, the casing part 34 is provided with a top surface 62, and a pair of threaded mounting screw receiving holes 64 intersect the top surface 62 whereby the transmissions 12 may be attached to the underside of the support frame 14 by bolts, not shown.

The drive shaft 48 consists of a single component having a reduced diameter portion within the chamber 44 as will be appreciated from FIG. 5, however, the portions of the drive shaft 48 rotatably located within the recesses 38 and 40 are of an equal diameter. The portion of the drive shaft 48 located within recess 38 constitutes an input portion 66 of the drive shaft while the drive shaft portion 68 located within the recess 40 constitutes an output portion 68 of the drive shaft. A connector 70 is mounted upon the input portion 66 of the drive shaft and includes a diametrical slot 72 as will be appreciated from FIGS. 2 and 5. A similar connector 70 is also mounted upon the output portion 68 of the drive shaft, in the drawings the connectors 70 mounted on a common shaft 48 are rotationally disposed at 90° to each other. The connectors 70 of adjacent transmissions 12 are interconnected in a torque transferring manner by a cross shaped key 74 which includes perpendicular related fingers having radial surfaces which are closely received within the slots 72 of the adjacent connectors 70 as will be appreciated from FIG. 2 to interconnect adjacent drive shafts 48. The connectors 70 and key 74 are of a conventionally available construction permitting the drive shafts 48 of adjacent transmissions to be interconnected in driven and driving relationship to adjacent transmissions and drive shafts, and the connectors 70 and key 74 will permit slight drive shaft misalignment while interconnecting the drive shafts of adjacent transmissions in a torque transmitting relationship. Accordingly, it will be appreciated that due to the driving and driven interrelationships between adjacent transmissions 12, the drive shafts of the transmissions will simultaneously rotate.

The transmission casing 32, in addition to including the primary or main casing part 34, includes a secondary casing part 78 which is complementaryily shaped with respect to casing part 34 and mounts upon the casing part 34 to define the complete transmission casing 32. The casing part 78 includes a flat parting surface 80, FIGS. 2 and 7, and includes chambers corresponding to chambers 44 and 46 for receiving the gears 52 and 54, and the thrust bearing 56. Likewise, as later described, the casing part 78 includes recesses for accommodating the drive shaft 48 and the output shaft 50. A plurality of holes 81 are formed in the casing part 78 intersecting the parting surface 80 and include enlarged countersunk portions 76 in alignment with the bosses 58 whereby the bosses 58 will be located within the countersunk portions 76 to facilitate alignment and assembly of the casing part 78 with the casing part 34. Screws 82, FIGS. 2 and 7, extend through the holes 81 and are received within the threaded holes 60 of the casing part 34 to assemble the casing parts 34 and 78 together. Usually, a thin gasket, or gasket material is located between the parting surfaces 36 and 80 when assembling the casing parts to produce a fluid tight relationship between the casing parts. Assembly of the casing parts 34 and 78 by the screws 82 results in the assembled relationship shown in FIG. 2 and the internal components of the transmissions 12 will be completely encased.

Figure 3:
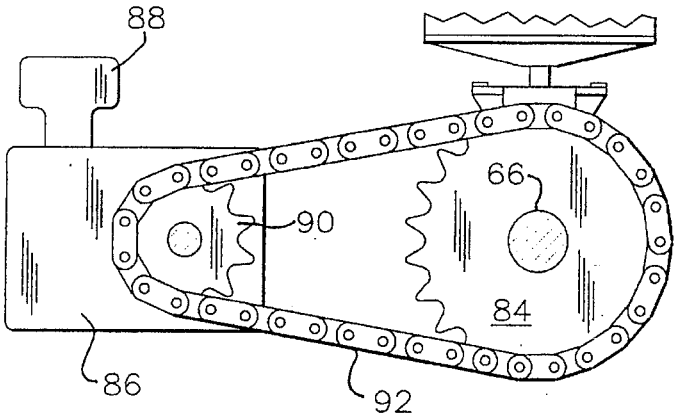
FIG. 3 is an elevational sectional view illustrating the chain drive apparatus for rotating the transmission drive shafts as taken along Section 3—3 of FIG. 2.

The drive shafts 48 of the transmissions 12 are rotated by a chain sprocket 84 mounted upon the input portion 66 of one of the interconnected transmissions as will be appreciated from FIG. 2. The chain sprocket 84 is connected to a transmission 86, FIG. 3, which is driven by an electric motor 88 which is connected to controls, not shown, permitting intermittent operation of the motor 88. A chain sprocket 90 is mounted upon the output shaft of the transmission 86, and the sprocket 90 is connected to the sprocket 84 by the chain 92. Accordingly, upon energizing of the electric motor 88, the transmission 86 will slowly rotate the sprocket 90, and the sprocket 84 will be rotated at an even slower speed and usually through only a 120° rotation. The transmission 86 is of the speed reduction type, and the intermittent operation of the motor 88, as closely timed by its controls, will accurately index the chain sprocket 84 as desired.

Rotation of the chain sprocket 84 will rotate the drive shaft 48 upon which the chain sprocket is mounted, and accordingly, all of the transmissions 12 interconnected together as shown in FIGS. 1 and 2 will simultaneously rotate producing a simultaneous indexing of the louvers 10 to permit changing of the viewable face of the louvers, permitting the louver face "behind" that previously visible to be observed.

As mentioned above, the secondary casing part 78 includes recesses for receiving the drive shaft 48 and the output shaft 50. These recesses are located within the casing part 78 in opposed relationship to the recesses 38, 40 and 42 defined in the casing part 34. These complementary recesses formed in the secondary casing part 78 for receiving the drive shaft 48 and the output shaft 50 will now be described in conjunction with FIG. 7.

Figure 6:
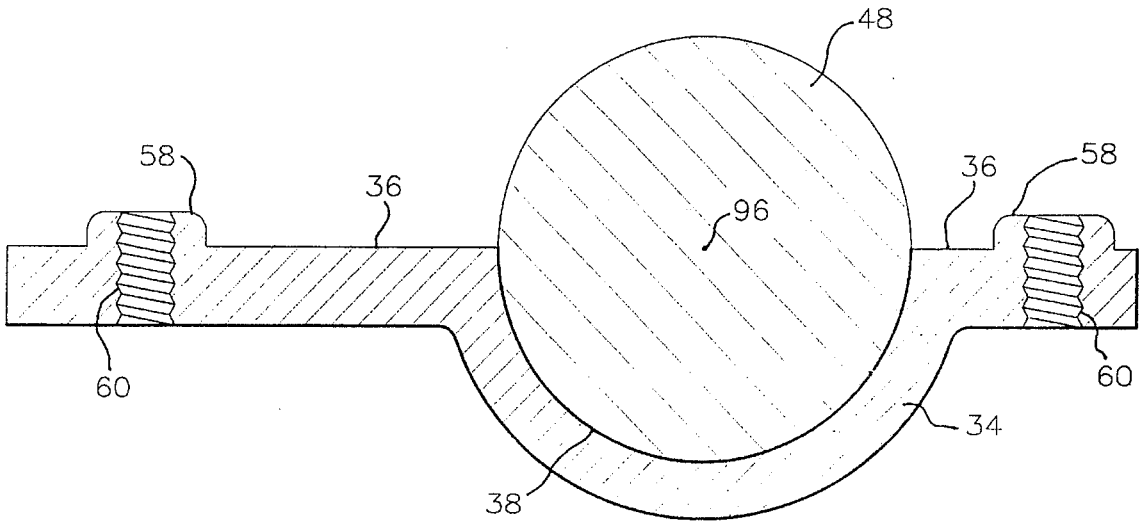
FIG 6 is an enlarged elevational sectional view as taken along Section 6—6 of FIG. 5, prior to the installation of the opposed casing half.
Figure 7:
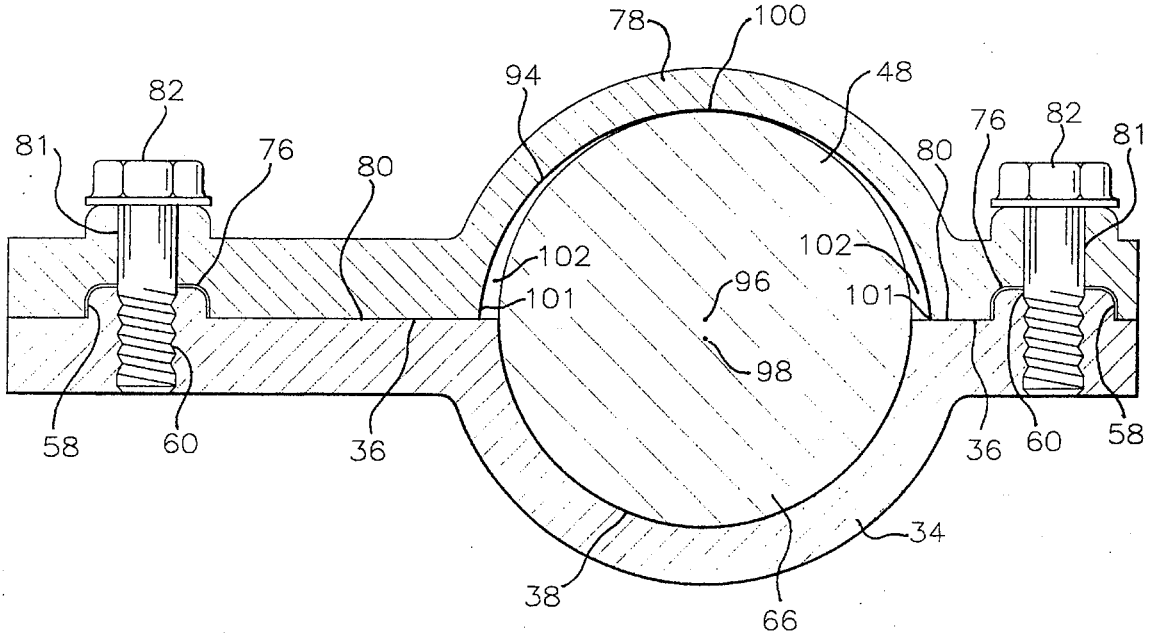
FIG. 7 is an elevational sectional view similar to FIG. 6 illustrating the casings interconnected and the apex of the second casing recess engaging the drive shaft.

In FIG. 7, the relationship between the assembled casing part 34 and casing part 78 as taken along Section 6—6 of FIG. 5 is illustrated upon the casing parts 34 and 78 being assembled. The casing part 78 includes a recess 94, FIG. 7, for receiving the input portion 66 of the drive shaft 48, and the recess 94 is of a slightly larger dimension than the diameter of the recess 38 formed in the casing part 34. The diameter of the recess 38 is substantially equal to the diameter of the drive shaft portion 66, and the center of the recess 38 lies within the plane of the parting surface 36, such center being represented at 96 in FIGS. 6 and 7, the center line of the shafts. The center of the recess 94 is represented at 98, and as will be appreciated from FIG. 7, the center of the recess 94 as shown at 98 lies "beyond" the plane of the parting surface 80 of the casing part 78. The diameter of the recess 94 is approximately 0.020 to 0.030 inches larger than the diameter of the recess 38, and by locating the center of the recess 94 beyond the plane of the parting surface 80, the recess 32 will include an apex at 100 which is circumferentially equal distant from the intersections of the recess 94 to the parting surface 80 as represented at 101 in FIG. 7. The larger diameter of the recess 94 with respect to the diameter of the drive shaft input portion 66 will produce clearances or radial spaces 102 between the recess 94 and the shaft input portion 66 adjacent the parting surfaces. 36 and 80 as will be appreciated from FIG. 7.

With reference to FIG. 7, it will be appreciated that upon tightening of the screws 82 to bring the parting surfaces 36 and 80 into engagement, or substantial engagement as separated by a thin gasket or sealing material, the location of the center 98 of the recess 94, and the diameter of the recess 94 is such that the apex 100 will engage the drive shaft input portion 66 in a line contact and with such force as to permit rotation of the drive shaft within the recesses 38 and 94 in a typical sleeve bearing clearance relationship. The circumferential extent of the recess 38 is 180°, while the circumferential extent of the recess 94 will be less than 180°, and the engagement of the apex 100 as defined in the recess 94 is sufficient to maintain the drive shaft input portion 66 in full engagement with the recess 38, and yet permit rotation of the drive shaft within the recesses 38 and 94. The force exerted on the drive shaft portion 66 by the apex 100 will fully maintain the drive shaft 48 within the recess 38 thereby accurately locating the drive shaft relative to the transmission casing parts 34 and 78, and the practice of the invention permits the accommodating of casting tolerances existing during the casting of the casing parts 34 and 78, and yet permits accurate positioning of the drive shaft within the transmission casing 32.

Preferably, the recesses defined in the secondary casing part 78 in opposed relationship to the primary casing part recesses 40 and 42 are also constructed in accord with the concepts described above relative to recess 94. Accordingly, the drive shaft 48 and the output shaft 50 will be accurately located within the transmission casing 32 by the line contact produced by the casing part 78 with the associated shaft.

Of course, due to the direct engagement of the drive shaft 48 and output shaft 50 with the shaft receiving recesses defined. in the casing parts 34 and 78, the material of the casing parts, itself, becomes the bearing material for the rotating shafts. Usually, the shafts 48 and 50 are formed of steel, while the casing parts are cast of an aluminum alloy. The elimination of separate bearings, bearing sleeves or more conventional shaft supporting structure significantly reduces the cost of transmissions 12 both from a fabricating and material standpoint, as well as simplifying assembly of the transmissions and associated components. The elimination of separate bearing structure for the shafts 48 and 50 is only possible due to the slow rate of indexing rotation of the shafts and the low lateral forces imposed upon the shafts in a louver sign environment. The shafts 48 and 50 will only index two or three times a minute, and will index only 120° at a time. Due to the relative light weight of the louvers 10, and the support of the weight of the louvers on the thrust bearing 56, lateral forces imposed upon the shafts 48 and 50 are low, and the practice of the inventive concepts within a louver sign embodiment are possible due to the very low rates of rotation or indexing of the transmission shafts through a partial revolution. The practice of the invention in the environment of a louver sign is particularly apropos in view of the need for large numbers of transmissions 12 and the low cost fabrication and assembly of transmissions 12 makes the use of louver sign transmissions constructed in accord with the invention feasible.

It is appreciated that various modifications to the inventive concepts may be apparent to those skilled in the art without departing from the spirit and scope of the invention.

I claim:

1. A louver type sign transmission system for a louver sign comprising a plurality of parallel, rotatable, adjacent louvers each having a plurality of indicia receiving surfaces and ends, comprising, in combination, an elongated support frame having first and second sides, a plurality of transmissions mounted on said frame on a common side thereof in side-by-side relationship, each of said transmissions including a drive shaft drivingly connected to an output shaft, said drive shafts and said output shafts of said transmissions each having an axis of rotation and the axes of rotation of said drive shafts of said transmissions being substantially coincident and parallel to the length of said frame, said axes of said output shafts being substantially perpendicular to said axes of said drive shafts and said output shafts extending through said frame, each of said transmissions' drive shafts having an exteriorly accessible input end portion and an output end portion, a torque transmitting connector mounted upon each drive shaft end portion, said torque transmitting connectors mounted upon said drive shafts' input end portions drivingly interconnecting with said torque transmitting connectors mounted upon said drive shafts' output end portion of an adjacent transmission whereby a plurality of adjacent transmission drive shafts are operatively interconnected, a motor drivingly connected to one of said drive shaft end portions for rotating said interconnected drive shafts, and a louver end support mounted upon each transmission output shaft supporting a louver end, whereby said transmissions' drive shafts rotate the louver end associated therewith upon rotation of said drive shafts.

2. In a louver type sign transmission as in claim 1, said torque transmitting connectors including engaging drive surfaces radially disposed to the associated drive shaft.

3. In a louver type sign transmission as in claim 2, dimensional tolerances defined on said torque transmitting connectors' drive surfaces to accommodate limited radial misalignment of said drive shaft axes of adjacent transmissions.

4. In a louver type sign transmission as in claim 1, said transmissions each including first and second casing parts defining a casing, removable fasteners interconnecting said casing parts, a first gear within said casing fixed upon the associated transmission drive shaft, a second gear within said casing fixed upon the associated transmission output shaft and drivenly meshing with said first gear, the material forming said first and second casing parts directly engaging said associated drive and output shafts and defining the bearing for said shafts.

5. In a louver type sign transmission system as in claim 1, said transmissions each including first and second casing parts each having a parting surface and together defining a casing, removable fasteners interconnecting said casing parts with said parting surfaces in opposed relationship and substantially engaging, a first semi-cylindrical recess defined in said first casing part intersecting said parting surface thereof directly receiving the associated drive shaft and having a diameter substantially equal to the received diameter of said drive shaft, a second substantially semi-cylindrical recess defined in said second casing part intersecting said parting surface thereof in opposed relation to said first semi-cylindrical recess when said casing parts are interconnected, said second recess being of a diameter greater than the diameter of said first recess, an apex defined on said second recess intermediate the intersection of said second part parting surface with said second recess, said apex engaging said drive shaft within said second recess upon said casing parts being fastened together at a limited location whereby said apex defines a bearing surface and maintains said drive shaft fully within said first recess.

6. In a louver type sign transmission system as in claim 5, said apex defined on said second recess comprising the portion of said second recess equidistant from the intersections of said second part parting surface with said second recess.

7. In a louver type sign transmission system as in claim 1, said transmissions each including first and second casing parts each having a parting surface and together defining a casing, removable fasteners interconnecting said casing parts with said parting surfaces in opposed relationship and substantially engaging, a first semi-cylindrical recess defined in said first casing part within said associated parting surface wherein the plane of said associated parting surface is diametrically associated to said first recess, said first recess having a diameter substantially equal to the diameter of the drive shaft received therein, a substantially semi-cylindrical second recess defined in said second casing part within said associated parting surface thereof having a circumference and having a diameter greater than the diameter of said first recess, the plane of said parting surface of said second part intersecting said second recess in a non-diametrical manner whereby the circumference of said second recess is less than 180°, the location on said second recess circumference equidistant from the intersections of said second casing parting surface with said second recess defining an apex within said second recess, said apex engaging said drive shaft within said second recess upon said casing parts being fastened together at a limited location whereby said apex defines a bearing surface and maintains said drive shaft fully within said first recess.

* * * * *